US007934751B2

(12) United States Patent
Castillo et al.

(10) Patent No.: US 7,934,751 B2
(45) Date of Patent: May 3, 2011

(54) LABEL SHEET ASSEMBLY, APPLICATION KIT AND METHOD OF USING THE SAME

(75) Inventors: Arthur G. Castillo, Chino Hills, CA (US); Le Hoa Hong, Monterey Park, CA (US); Douglas William Martin, La Habra, CA (US); Elizabeth Marie Sanchez, Glendale, CA (US); Jesus Angel Urbina Moriel, Júarez (MX); Carlos Lobato Ramón, Júarez (MX); Jose Elias Pinto Muñoz, Júarez (MX); Ronald Ugolick, San Dimas, CA (US); Jerry Grant Hodsdon, Forestdale, MA (US); Anahit Tataryan, Temple City, CA (US)

(73) Assignee: Avery Dennison Corporation, Pasadena, CA (US)

( * ) Notice: Subject to any disclaimer, the term of this patent is extended or adjusted under 35 U.S.C. 154(b) by 252 days.

(21) Appl. No.: 11/590,409

(22) Filed: Oct. 31, 2006

(65) Prior Publication Data

US 2007/0262578 A1 Nov. 15, 2007

Related U.S. Application Data

(60) Provisional application No. 60/799,238, filed on May 9, 2006.

(51) Int. Cl.
*B42F 21/00* (2006.01)
*B42F 15/00* (2006.01)

(52) U.S. Cl. ..... 283/37; 283/36; 283/39; 283/41; 283/81

(58) Field of Classification Search ..... 40/310, 40/312, 359, 360, 638; 281/38, 51; 283/3, 283/36, 37, 38, 39, 40, 41, 42, 72, 81, 103, 283/117; 402/79; 428/40.1, 42.1, 42.2, 42.3, 428/66.6, 192, 194, 914; *B42D 15/00; G09F 03/00, 03/10*

See application file for complete search history.

(56) References Cited

U.S. PATENT DOCUMENTS 3,805,426 A 4/1974 Cunningham (Continued)

FOREIGN PATENT DOCUMENTS

CA 2409986 11/2001

(Continued)

OTHER PUBLICATIONS

Pollman; Index Divider Label Application and Alignment Kit and Method of Using Same; PCT/US98/07326; WO 98/47771; Oct. 29, 1998.*

(Continued)

*Primary Examiner* — Dana Ross
*Assistant Examiner* — Justin V Lewis

(57) ABSTRACT

An improved label sheet assembly and application kit including an optional liner sheet, a carrier strip, and a removably attached label facestock sheet. The application kit further includes a stacked group of tabbed sheets and an alignment guide. The label facestock sheet assembly includes a plurality of cut lines defining a perimeter of a plurality of facestock labels spaced from one another in an offset manner that substantially corresponds to a set of staggered tabs extending outwardly from a stacked group of divider sheets. The carrier strip is defined by a plurality of cuts having substantially the same shape as a portion of the perimeters of the facestock labels, but with slightly smaller dimensions as its respective label. The user may separate the carrier strip from the liner sheet, exposing an adhesive back of the precut labels and place and align the carrier strip across the divider sheets such that the precut labels are placed on the tabs of the divider sheets. The user then pulls the carrier strip upwardly and away from the divider sheets such that a portion of each of the perimeters of the precut labels flexes to separate from the carrier strip and remain on the staggered tabs.

49 Claims, 8 Drawing Sheets

U.S. PATENT DOCUMENTS

| | | | | |
|---|---|---|---|---|
| 4,478,666 | A | 10/1984 | Ogden | |
| 5,135,261 | A | 8/1992 | Cusack et al. | |
| 5,227,209 | A | 7/1993 | Garland | |
| 5,340,427 | A | 8/1994 | Cusack et al. | |
| 5,462,783 | A | 10/1995 | Esselmann | |
| 5,468,085 | A | 11/1995 | Kline | |
| 5,484,168 | A | 1/1996 | Chigot | |
| 5,503,435 | A | 4/1996 | Kline | |
| 5,947,525 | A | 9/1999 | Pollman | |
| 6,013,154 | A | 1/2000 | Thomas-Cote | |
| D423,044 | S | 4/2000 | Burke et al. | |
| 6,086,107 | A | 7/2000 | Whistler et al. | |
| 6,132,831 | A | 10/2000 | Thomas-Cote | |
| 6,221,192 | B1 | 4/2001 | Walsh | |
| 6,277,456 | B1 | 8/2001 | Bulgrin et al. | |
| 6,364,366 | B1 | 4/2002 | Schwartz | |
| 6,479,118 | B1 | 11/2002 | Atkinson | |
| 6,508,914 | B1 | 1/2003 | Schwaller et al. | |
| D475,740 | S | 6/2003 | Kuenz | |
| 6,594,933 | B2 | 7/2003 | Attia et al. | |
| 6,748,994 | B2 | 6/2004 | Wien et al. | |
| 6,803,084 | B1 * | 10/2004 | Do et al. | 428/40.1 |
| 6,989,183 | B2 | 1/2006 | McKillip | |
| 7,208,212 | B2 * | 4/2007 | Do et al. | 283/37 |
| 7,306,690 | B2 | 12/2007 | Hodsdon et al. | |
| 2001/0025689 | A1 * | 10/2001 | Barnet | 283/81 |
| 2002/0086127 | A1 | 7/2002 | Hodsdon et al. | |
| 2003/0066219 | A1 | 4/2003 | Palumbo | |
| 2003/0129347 | A1 | 7/2003 | Kuo et al. | |
| 2004/0101646 | A1 | 5/2004 | Hodsdon et al. | |
| 2004/0137199 | A1 * | 7/2004 | Flynn et al. | 428/131 |
| 2005/0001422 | A1 * | 1/2005 | O'Keefe et al. | 283/98 |
| 2005/0048244 | A1 | 3/2005 | Do et al. | |
| 2006/0040084 | A1 | 2/2006 | Erwin et al. | |
| 2008/0054622 | A1 | 3/2008 | Hodsdon et al. | |
| 2008/0061548 | A1 | 3/2008 | Kuranda et al. | |

FOREIGN PATENT DOCUMENTS

| | | |
|---|---|---|
| DE | 202004011509 | 9/2004 |
| EP | 1319601 | 6/2003 |
| JP | 2000-326944 | 11/2000 |
| WO | 98/47771 A2 | 10/1998 |
| WO | 01/89821 | 11/2001 |
| WO | WO 01/89825 A1 | 11/2001 |
| WO | WO 02/083403 | 10/2002 |

OTHER PUBLICATIONS

Wein; Label Applicator, Method and Label Therefor; PCT/US02/11512; WO 02/083403; Oct. 24, 2002.*

International Search Report, PCT/US2006/042604, May 7, 2007.

* cited by examiner

LABEL SHEET ASSEMBLY, APPLICATION KIT AND METHOD OF USING THE SAME

CROSS-REFERENCES TO RELATED APPLICATIONS

This application claims the benefit of U.S. Provisional Application No. 60/799,238, filed May 9, 2006.

TECHNICAL FIELD

The present invention generally relates to labels and, more particularly, relates to an improved index divider label sheet assembly, method of application, and an application kit including the label sheet assembly.

BACKGROUND

Various systems for indexing documents utilizing dividers and labels are available. In a typical system, documents are separated by divider sheets to aid with identification of the documents. The dividers often include tabs having indicia thereon for helping a user to locate and organize documents.

While such systems may have been satisfactory for helping to index groups of documents, the task of applying identifying indicia or identifying labels to the divider tabs is time consuming, clumsy and subject to error. In many systems, tab attachable labels have been employed to help overcome such difficulties. Typically, during application the individual labels are separated from one another and then attached individually to corresponding ones of the divider tabs. In the course of individually applying the labels, they are often not applied evenly, or properly aligned with the divider sheet tabs. Even though the use of this type of attachable labels may have permitted the divider tabs to have identifying indicia, such labels have not been convenient to use.

Previous patents have taught various remedies for overcoming these shortcomings when applying tabs to index dividers. One previous example includes the use of precut labels attached to carrier strips that are in turn secured to a backing sheet. The precut labels are spaced apart on the carrier strips to align substantially on the tabs on the divider sheets. The user can separate a carrier strip and precut labels affixed thereto from the backing sheet, place and align the carrier strip across the divider sheet such that the precut labels are placed on the tabs of the divider sheets. The carrier sheet is then pulled upwardly and away from the divider sheet such that the precut labels separate from the carrier strip and remain on the divider's tabs. This system, while an improvement in certain respects over the prior art, has the disadvantage that the strips are typically flimsy and difficult to properly align. Additionally, the carrier strip can be sticky and thus may stick to unwanted surfaces.

Another remedy for the shortcomings faced when applying tabs to index dividers includes the use of a facestock adhered with releasable adhesive to a liner sheet. Die cut lines are made through the facestock to define labels to be aligned with either one or more sets of dividers or sets of file folders. Different pattern die cut lines are made through the liner sheet so that a strip can be removed directly from behind the labels, exposing the adhesive side of the labels. The labels are temporarily held onto the remainder of the facestock by small ties. After alignment and adhesion to the dividers, the facestock is then pulled upwardly and away from the divider sheet. This movement breaks the ties, leaving just the labels on the substrate. This system while a further improvement requires the use of ties to maintain the labels during alignment of the labels with the dividers. The ties may prove to be a disadvantage in that they may leave rough edges about the perimeter of the label where the ties have been broken during removal of the label sheet.

Another shortcoming of previous patents is that after removal of the strip and application of the labels onto the substrate, the sheet is no longer printable. In one instance the sheet is an irregular size after the strip is removed. Irregular sheets may have difficulty passing through printers or copiers. In another instance, after the labels have been applied to the substrate, the sheet has holes where the labels were. The holes may impart unwanted flexibility in the sheet or may provide catch points causing difficulty in passing through a printer or copier. Further removal of the labels and liner exposes adhesive on the remainder of the sheet, which may cause the sheet to adhere to the feed mechanism in a printer or copier. Thus, since printing after label removal may be problematic, all the labels should be printed in a single printing step. Any unprinted labels could not be printed in a second pass through the printer or copier and would have to be used unprinted or wasted.

Therefore it would be highly desirable to have a new and improved index divider label applicator construction, method of application, and an alignment kit and method of using the same to facilitate the application of tab labels in a fast, efficient, and accurately aligned manner. Such a new and improved label and method should enable a user to apply all of the divider tab labels substantially simultaneously. Furthermore, other desirable features and characteristics of the present invention will become apparent from the subsequent detailed description and the appended claims, taken in conjunction with the accompanying drawings and the foregoing technical field and background.

BRIEF SUMMARY

There has now been developed a new label sheet assembly and assembly kit. In one embodiment, the label sheet assembly comprises a label facestock and a carrier strip. The label facestock sheet is removably affixed with adhesive to the front face of the carrier strip in an overlying aligned manner. The label facestock sheet includes a plurality of cut lines defining at least a perimeter of a plurality of labels spaced from one another in an offset manner that substantially corresponds to a set of staggered tabs extending outwardly from a stacked group of tabbed members having a predefined arrangement of tab. The carrier strip is defined by a plurality of cut edges having substantially the same shape as a portion of the perimeters of the facestock labels, but with slightly smaller dimensions as its respective plurality of labels. The carrier strip overlaps at least a portion of each of the plurality of labels defining an overlapping portion. The overlapping portion is adapted to expose a back adhesive surface of each of the labels in the plurality of labels when the carrier strip is in a separated position.

In a further embodiment, still by way of example only, there is provided a label sheet assembly, comprising a liner sheet, a carrier sheet having a back face and a front face, and a label facestock sheet. The carrier sheet back face is removably affixed to the front face of the liner sheet in an overlying aligned manner. The label facestock sheet is removably affixed with adhesive to the front face of the carrier sheet in an overlying aligned manner. The label facestock sheet includes a plurality of cut lines extending through the label facestock sheet but not through the carrier sheet. The plurality of cut lines define at least a perimeter of a plurality of labels spaced from one another in an offset manner that substantially corresponds to a set of staggered tabs extending outwardly from a stacked group of tabbed members having a predefined arrangement of tabs. The liner sheet, the carrier sheet and the label facestock sheet form a laminate construction sheet. The carrier sheet includes a plurality of cut lines extending through the carrier sheet but not through the label facestock sheet or the liner sheet and having substantially the same shape as a portion of the perimeters of the labels, but with slightly smaller dimensions as its respective the label to define a plurality of carrier strips. Each of the carrier strips is capable of being removed from the liner sheet to expose an overlap of a portion of the label on the carrier strip and a back adhesive surface of each of the labels such that the carrier strip can assist the user in positioning the labels at desired locations on at least one surface and adhered thereto with the adhesive. The at least one surface includes the staggered tabs of the stacked group of tabbed members.

In still a further embodiment, and still by way of example only, there is provided a label sheet assembly, comprising a liner sheet, a carrier sheet removably attached to the liner sheet and a label facestock sheet. The carrier sheet includes at least one weakened separation line defining at least in part a carrier strip. The label facestock sheet is removably attached to the carrier sheet. The label facestock sheet includes at least one weakened separation line defining at least in part perimeters of a plurality of aligned labels. The carrier strip is in an attached position on the liner sheet and constructed so as to be positionable in an alternative removed position when removed from the liner sheet. Portions of the bottom surfaces of the labels are exposed when the carrier strip is in the removed position. At least a portion of the perimeter of the labels is overlapping the carrier strip to define a carrier strip overlap portion and reversibly adhered thereto such that the labels are adapted to be applied in an aligned applied position to a plurality of staggered tabs. The assembly further includes an adhesive means for adhering the carrier sheet to the facestock sheet when in the attached position and for also adhering the labels to the staggered tabs when the labels are in the applied position.

In still yet a further embodiment, and still by way of example only, there is provided an index divider label application kit comprising An index divider label application kit comprising at least one set of divider sheets, at least one pressure sensitive label sheet assembly including at least one carrier strip, and an alignment guide for aligning the at least one carrier strip with the divider tabs on the set of divider sheets. The at least one set of divider sheets, each having outwardly extending divider tabs vertically offset from one another in a predetermined arrangement when the divider sheets overlay one another. The at least one pressure sensitive label sheet assembly includes at least one carrier strip, and a label facestock sheet, the at least one carrier strip and the label facestock sheet removably secured together by a layer of a pressure sensitive adhesive material. The label facestock sheet includes a plurality of cut lines defining a perimeter of a plurality of spaced apart precut labels aligned in an alignment configuration that corresponds substantially to the predetermined arrangement of the divider tabs extending outward from the divider sheets. The at least one carrier strip includes a plurality of cut edges having substantially the same shape as a portion of the perimeters of the facestock labels, but with slightly smaller dimensions as its respective the label, such that when the at least one carrier strip overlies the divider tabs on the set of divider sheets, each of the precut labels is located on top of a respective divider tab. The precut labels are reversibly adhered to the at least one carrier strip about an edge that overlaps the at least one carrier strip. The user is capable of (1) using the alignment guide to align the at least one carrier strip with the divider tabs on the set of divider sheets, (2) separating the at least one carrier strip and precut labels affixed to that the at least one carrier strip from the liner sheet and the label facestock sheet, (3) placing and aligning the at least one carrier strip across the divider sheets such that the precut labels affixed to the at least one carrier strip are placed on the divider tabs of the divider sheets, and (4) pulling the at least one carrier strip upwardly and away from the divider sheets such that the at least one edge of the label that overlaps the at least one carrier strip flexes about the at least one carrier strip when the at least one carrier strip is separated from the labels so that they remain on the divider tabs.

Other independent features and advantages of the improved index divider label sheet assembly will become apparent from the following detailed description, taken in conjunction with the accompanying drawings which illustrate, by way of example, the principles of the invention.

BRIEF DESCRIPTION OF THE DRAWINGS

The present invention will hereinafter be described in conjunction with the following drawing figures, wherein like numerals denote like elements.

DETAILED DESCRIPTION

The following detailed description is merely exemplary in nature and is not intended to limit the invention or the application and uses of the invention. Furthermore, there is no intention to be bound by any expressed or implied theory presented in the preceding technical field, background, brief summary or the following detailed description.

In the following description, a label facestock is a sheet that may be formed from various materials, and more particular a printable sheet material, such as a paper or film, in which the individual labels are formed that will readily adhere to index divider surfaces. The label facestock may be multilayered and may comprise laminated sheets. Further, the label facestock may also include various coatings to impart surface characteristics such as ink or toner receptivity, gloss, color, etc. A multilayered laminated label sheet assembly at least initially includes at least two components: the label facestock and a carrier sheet. In addition, a liner sheet may be included in the assembly. An adhesive is positioned between the label facestock and an optional silicone release layer formed on an uppermost surface of the carrier sheet. There is also included an optional second silicone release layer between the carrier sheet and the liner when included. Each of the subsequently-described label sheet assemblies may additionally include a leader portion uniquely combined with a portion of the label facestock to form a multilayered laminated label sheet assembly capable of being fed through a copier or printer, such as a laser jet printer, ink jet printer, or the like. As will become apparent from the following detailed descriptions, the embodiments herein allow the user to remove the entire line or row of labels for simultaneously application to a line of stacked, staggered index divider tabs in a manner that is an improvement over the prior art. In other embodiments, partial rows or individual labels may be removed.

Each of the cut lines described herein will typically penetrate only one of the carrier sheet or the label facestock sheet. The cut portions of the label facestock are maintained on the sheet assembly by an adhesive so that they will not separate from the sheet assembly while being passed through a printer or copier.

Figure 1:
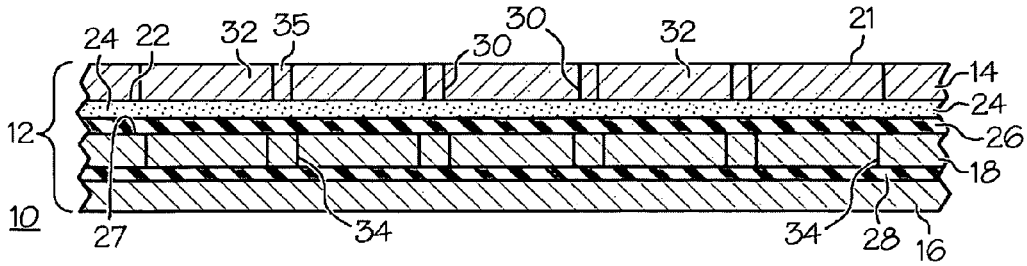
FIG. 1 is an enlarged cross-sectional view of a label sheet assembly taken along line 1-1 of FIG. 3 according to an embodiment of the present invention.
Figure 2:
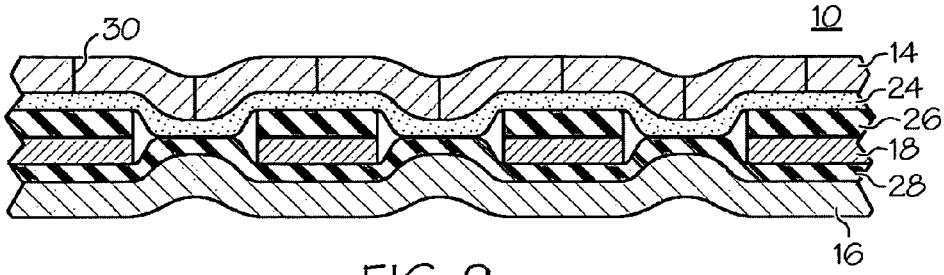
FIG. 2 is an enlarged cross-sectional view of a label sheet assembly taken along line 2-2 of FIG. 3 according to an embodiment of the present invention.
Figure 3:
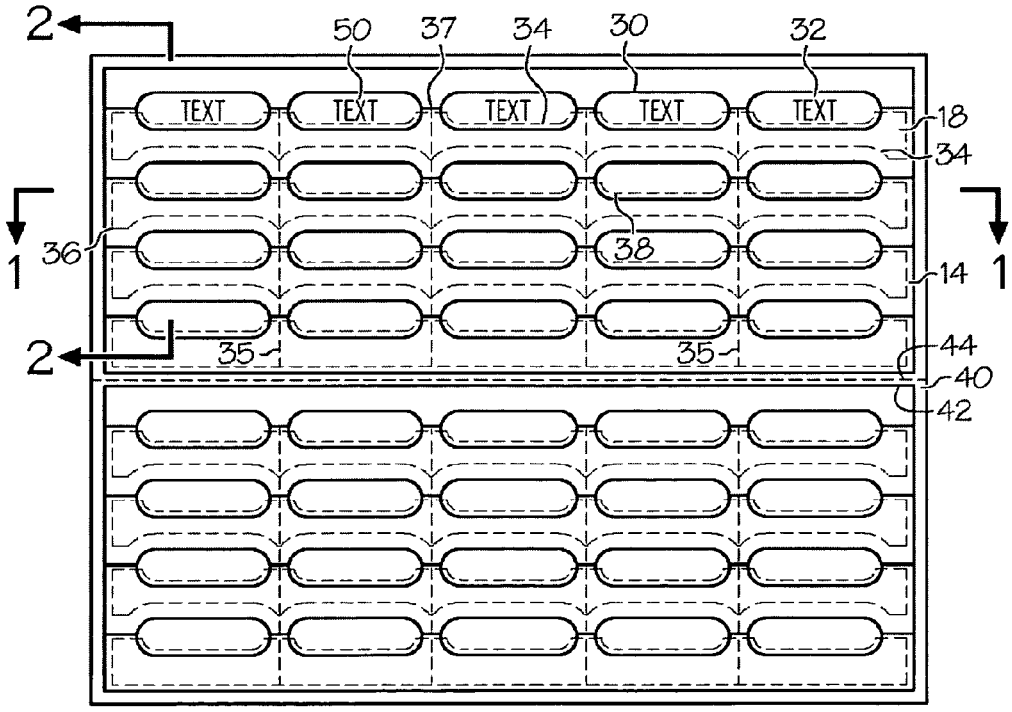
FIG. 3 is a front view of the label sheet assembly of FIGS. 1 and 2.
Figure 4:
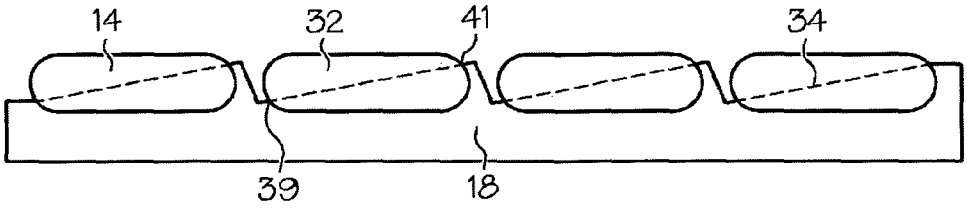
FIG. 4 is an enlarged view of a portion of a carrier strip according to another embodiment of the present invention.
Figure 5:
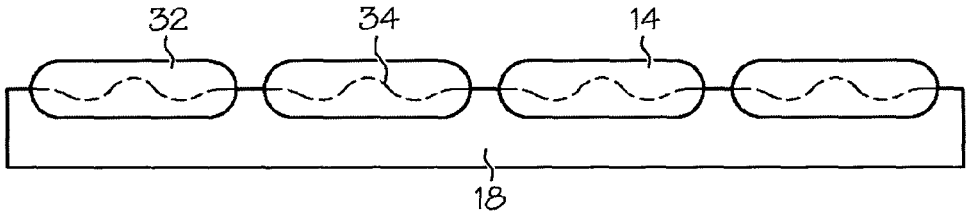
FIG. 5 is an enlarged view of a portion of a carrier strip according to another embodiment of the present invention.
Figure 6:
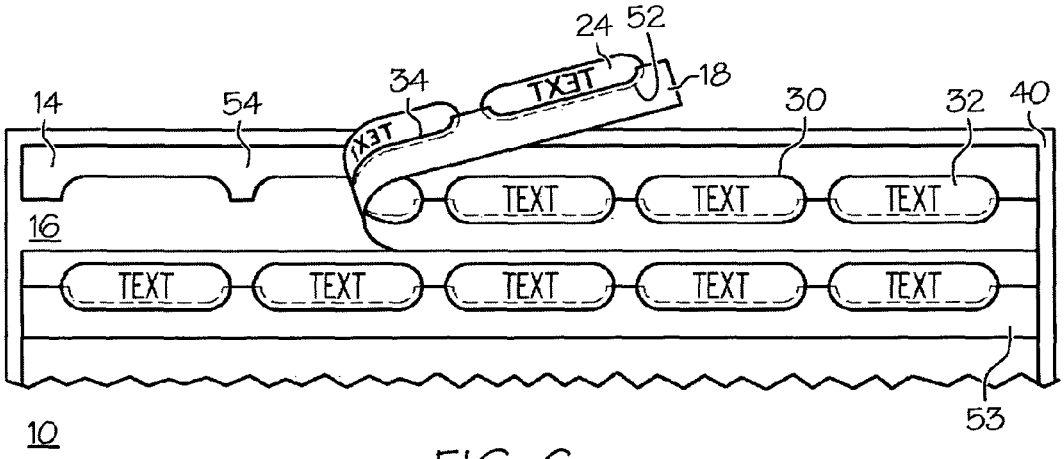
FIG. 6 is a perspective view showing of a first application step by a user of a label assembly of FIG. 1.
Figure 7:
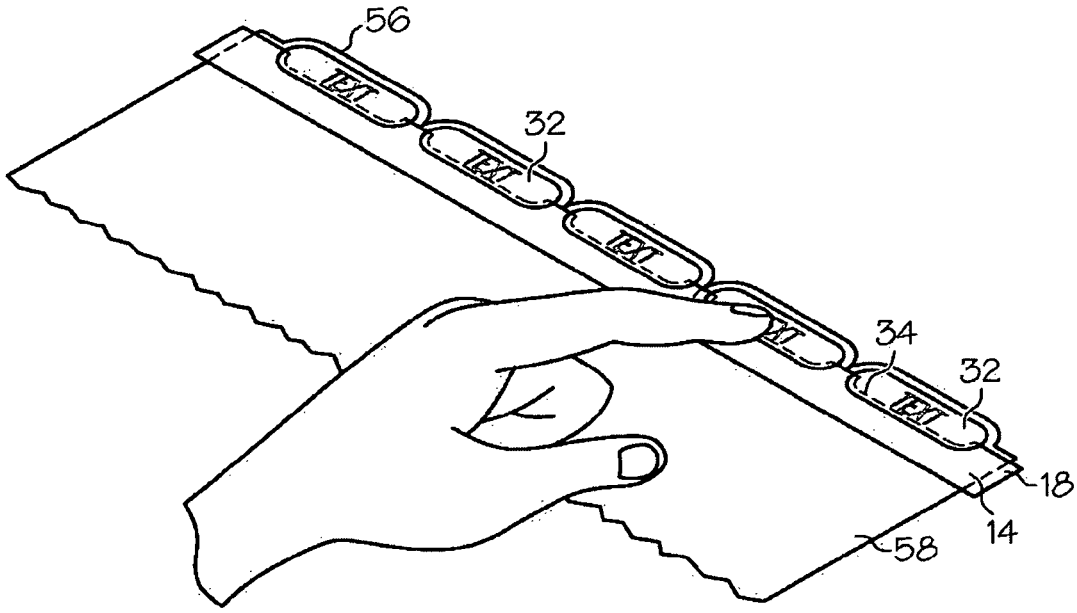
FIG. 7 is a perspective view of a second application step.
Figure 8:
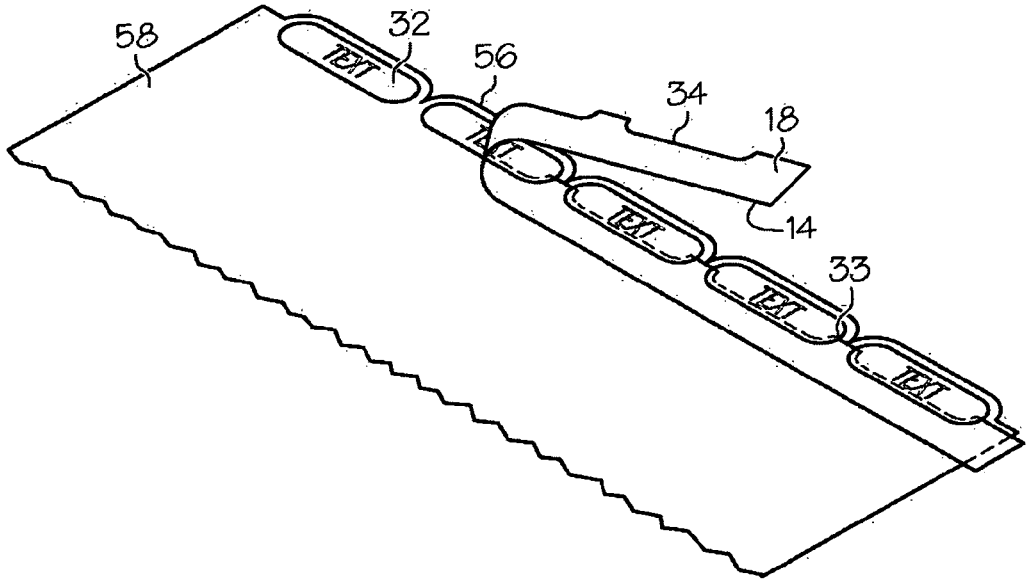
FIG. 8 is a perspective view of a third application step.

FIGS. 1-8 depict an embodiment of a label sheet assembly according to the present invention, showing die cut configurations for index divider labels. More specifically, referring to FIGS. 1-3, illustrated are cross-section views and a front view of the label sheet assembly according to the present invention. FIGS. 4 and 5 illustrate alternative carrier strip geometries and FIGS. 6-8 illustrate steps in the method of applying the labels to index dividers according to the present invention. Referring now to FIGS. 1 and 2, illustrated is a portion of a label sheet assembly 10 comprised of multiple layers 12. FIG. 1 illustrates a sectional view taken through line 1-1 of FIG. 3, and FIG. 2 illustrates a sectional view taken along 2-2 of FIG. 3. As depicted in FIGS. 1 and 2, the label sheet assembly 10 includes a label facestock 14, a liner 16, and a carrier strip 18 sandwiched therebetween. The label facestock 14 is defined by a first side 21 and an opposed second side 22. In this particular embodiment, label facestock 14 has an ink or laser receptive printable surface on first side 21. There is formed between the carrier strip 18 and the label facestock 14, an adhesive layer 24 positioned on the second side 22 of the label facestock 14. Adhesive layer 24 releasably adheres the label facestock 14 to the carrier strip 18. A silicone release layer 26 is optionally included on a carrier strip upper surface 27 between the carrier strip 18 and the facestock 14. In addition, an optional silicone release layer 28 is sandwiched between the carrier strip 18 and the liner 16. It should be understood that the silicone release layers 26 and 28 are optional in an embodiment including a removable or ultraremovable adhesive as the adhesive layer 24. It is anticipated that amongst the more traditional techniques for forming the various layers of the label sheet assembly of the present invention, that a pattern coating technique can be used for laying down the plurality of layers for the disclosed embodiments, including, but not limited to, the adhesive layers, the silicone release layers, and the heat activated coating.

Referring now to FIG. 3, the label facestock 14 includes a plurality of cuts 30 that extend through the label facestock 14 (as best seen in FIGS. 1 and 2) and define a perimeter of one or more labels 32, or portions of labels. In this particular embodiment the label facestock sheet 14 is cut by the cut lines 30 into two sets of five columns and four rows of labels. The plurality of cuts 30 are preferably formed using a rotary die cutter or cutters that are capable of cutting and scoring soft to semi-rigid material by forcing it between the blades on a cylindrical die and a hard cylindrical anvil, but in the alternative can be formed by a slicing process, such as done with a sign cutter. In a preferred embodiment, the cut lines 30 are continuous die cut. In an alternate embodiment, the cut lines 30 may comprise die cuts in the areas forming the labels 32 and may comprise other weakened lines, such as perforations, in areas not forming the labels 32.

In the embodiment illustrated in FIGS. 1-3, included is a plurality of labels 32 for placement on a plurality of staggered tabs of a set of index dividers. It should be understood that while a specific configuration of the labels 32 is depicted, any one of numerous label configurations is anticipated by this disclosure dependent upon end use. Accordingly, different numbers of columns and rows or different patterns (non-matrix) of the labels can be formed as needed. In addition, as illustrated in FIG. 3, the carrier strip 18 includes a plurality of edges 34 and may further include additional weakened lines 35 that allow the carrier strip 18 to separate into two or more smaller strips. The weakened lines 35 are formed through both the label facestock 14 and the carrier strips 18 to allow for separation. The smaller strips allow the user to select and remove a subset of the labels 32.

Referring again to FIG. 3, a portion of the plurality of edges 34 extends from an outermost region 36 of assembly 10 a distance, and then extend down, across and up, parallel to a portion of an outer shape or perimeter of an adjacent label 32 but spaced inwardly a slight distance therefrom and extending out to form a small plateau 37 between adjacent labels 32 similar to the spacing on the label facestock 14 between the adjacent labels 32. It should be appreciated that during the fabrication of sheet assembly 10, the carrier strips 18 may be formed to extend completely across the sheet assembly 10 or in the alternative do not extend completely across the sheet assembly 10. A portion of the carrier strip edge 34 as stated is spaced inwardly a slight distance from a portion of the perimeter of the labels 32. This allows a portion of the carrier strip 18 to overlap the die cuts 30 formed in the label facestock 14 and defining labels 32. This overlap area 38 is preferably less than approximately 20% of the area of label 32. Although, an overlap that exceeds approximately 20% of the area of label 32 could be implemented. It will be appreciated that this amount of overlap could make it difficult to remove the carrier strip 18 after the labels 32 have been applied to the tabs of the index dividers (discussed presently). Moreover, the overlap 38 will vary depending, for example, on the type of adhesive that may be used. For example, adhesives ranging from permanent to ultraremovable maybe used for adhesive layer 24. For embodiments in which an aggressive, permanent adhesive is used for adhesive layer 24, the overlap area 38 will be relatively small, as compared to embodiments in which a removable adhesive is used. Thus, while the specific amount of overlap 38 may vary, it will be appreciated that the overlap 38 should be sufficiently large to hold the labels 32 during handling, but sufficiently small to allow clean removal of the carrier strip 18 from the label 32 after application (described presently).

Referring now to FIGS. 4 and 5, illustrated are top views of a portion of the carrier strip 18 having been removed from the liner 16 in which alternative overlap geometries are illustrated. More specifically, illustrated in FIG. 4 is an embodiment in which the carrier strip edge 34 substantially evenly divides label 32 and extends generally from a first corner 39 to a second opposed corner 41. FIG. 5 illustrates an embodiment in which the carrier strip edge 34 is formed having a waved or bumped geometry. In both alternative embodiments illustrated, the carrier strip edge 34 does not follow the general shape of the label 32 as previously described with regard to FIG. 3, yet allows sufficient overlap between the carrier strip 18 and the facestock 14, and more particularly label 32, to: (i) hold the labels 32 during handling, (ii) allow for clean removal of the carrier strip 18 after application, (iii) facilitate the adhering of the label 32 to the surface of the dividers, etc., and (iv) provide for efficient manufacturability.

Referring again to FIG. 3, both the carrier strip 18 and the label facestock 14 preferably have additional cut lines. As can be understood from FIG. 3, portions of the label facestock 14 have been cut and stripped away to form the edge margins 40 of the sheet assembly 10. In addition, any portion of the carrier strip 18 formed in this area has also been stripped away. These margins 40 are provided to optimize printer and copier performance of the label sheet assembly 10. Additionally, an optional gutter strip 42 has been cut and removed from the center and a perforation line 44 formed down the center of the label facestock 14. This allows the construction to be divided into two parts by the user. It should be appreciated that other forms of weakened lines may be used in place of the perforation line 44 to divide the sheet assembly 10. Two smaller label applicator construction sheet assemblies are thereby formed for passing through a printer or as may be desired by the user.

After passing through a printer or copier, and with desired indicia 50 printed on the labels 32, the labels 32 are ready to be adhered to the tabs of an index divider, folder, or the like. Referring now to FIGS. 6-8, illustrated are perspective views of a top portion of the label sheet assembly 10 according to FIGS. 1-3, showing a plurality of steps for applying a first series of printed labels 32. As illustrated in FIG. 6, initially the carrier strip 18, including a portion 52 of the label facestock 14 of the sheet assembly 10 is pulled away and separated from a remainder portion 54 of the sheet assembly 10. It should be appreciated that although illustrated as being pulled from a specific direction relative to the edges of the sheet assembly 10, the carrier strip 18 may be formed to be pulled from either direction adjacent an edge of the sheet assembly 10, or both. During this step, the labels 32 are removed from the full liner sheet 16 when the user detaches the carrier strip 18 from the full liner sheet 16, exposing the adhesive side 24 of the labels 32. At this point a portion of each label 32 overlaps with the carrier strip 18 and is adhesively held onto the carrier strip 18 by the adhesive connection between the label facestock 14 and the carrier strip 18. This overlap of the labels 32 with the carrier strip 18 negates the need for other means of tying the labels 32 together at this stage. It should be noted that the carrier strip edges 34 follow both the horizontal and vertical cuts 30 of the label 32, thereby providing support on at least a portion of three sides of the label 32. As a result, the carrier strip 18 provides a strong, not flimsy, means for manipulating and accurately positioning a row of exposed labels 32 onto the desired positions of a plurality of staggered tabs 56 of a plurality of index dividers 58 as shown in FIGS. 7 and 8.

Holding the carrier strip 18 with the labels 32 having their adhesive sides exposed, the user then aligns the labels 32 with the tabs 56 of the index dividers 58. Each of the properly positioned labels 32 is then pressed flat down to form a strong adhesive bond onto the respective tabs 56 as depicted in FIG. 7. The carrier strip 18 to which the labels 32 are less strongly adhesively attached is then pulled away from the adhered labels 32, leaving just the labels 32 on the tabs 56 as illustrated in FIG. 8. In that the carrier strip 18 has been removed from the liner 16 having the labels adhesively attached thereto, the liner 16 remains the original size and is described as multipassable. To prepare more labels 32 for new tabs if additional labels were not previously printed, the user simply reruns the multipassable label sheet assembly 10 through the printer, printing on the subsequent array of labels to produce aligned, printed tab labels. It should be understood that the user can print as many labels as needed during a single printing process. Referring back to FIG. 6, after printing, a next carrier strip 53 may be removed from the liner sheet 16 to expose the backsides of the second line of printed labels 32. The second line of printed labels 32 is then manipulated into position on a second set of staggered dividers (not shown), the labels 32 pressed into position and the carrier strip removed. This can be understood by again viewing FIGS. 6 through 8.

As best illustrated in FIG. 8, during adherence of the labels 32 to the tabs 56, for a brief moment a portion of the carrier strip 18 is positioned between the divider tab 56 and the label 32. The user after pressing the label 32 against the divider tab 56 adheres a major portion of the label 32 to the divider tab 56 and the small overlap area 38 is attached to the carrier strip 18. The carrier strip 18 is then pulled past the labels 32 so that the label edges 33 bend or flex slightly to allow the carrier strip 18 to be removed. The label 32 exhibits sufficient tension and memory in its material to cause the edges 33 that are lifted up during removal of the carrier strip 18 to snap back onto the divider tab 56. The user may then smooth the edges to ensure complete adhesion.

Figure 9:
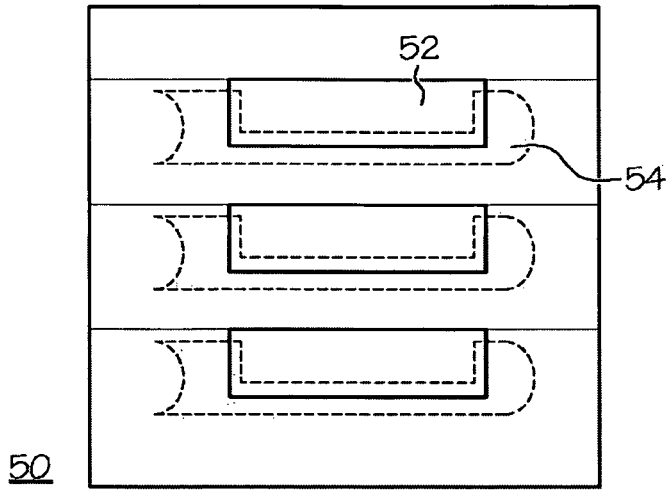
FIG. 9 is a front view of a label sheet assembly according to yet another embodiment of the present invention.

Referring now to FIG. 9, illustrated is an embodiment of a sheet assembly 50 formed in generally the same manner as the sheet assembly 10 described in FIGS. 1-3. In this particular embodiment, a single label 52 is formed on a carrier strip 54 to allow for removal and positioning of a single label 52. Each label 52 may be printed and peeled away from a liner for individual placement. It should be understood that the label 52 size and placement can vary depending upon the specific application for the label 52.

Figure 10:
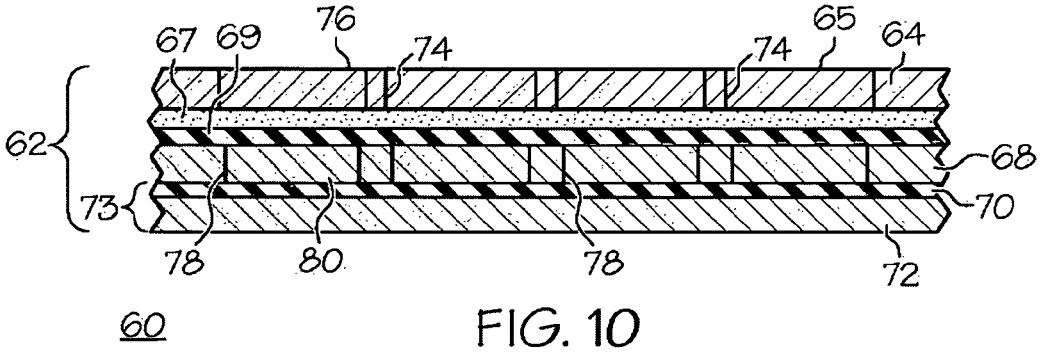
FIG. 10 is an enlarged cross-sectional view of a label sheet assembly taken along line 10-10 of FIG. 11 according to another embodiment of the present invention.
Figure 11:
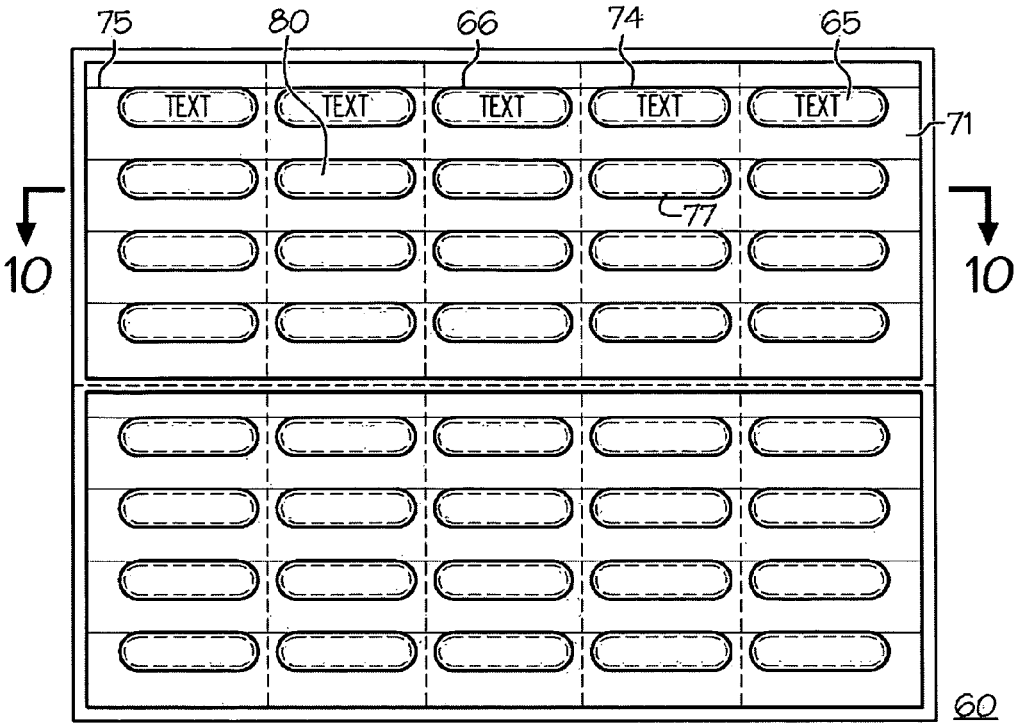
FIG. 11 is a front view of the label sheet assembly of FIG. 10.
Figure 12:
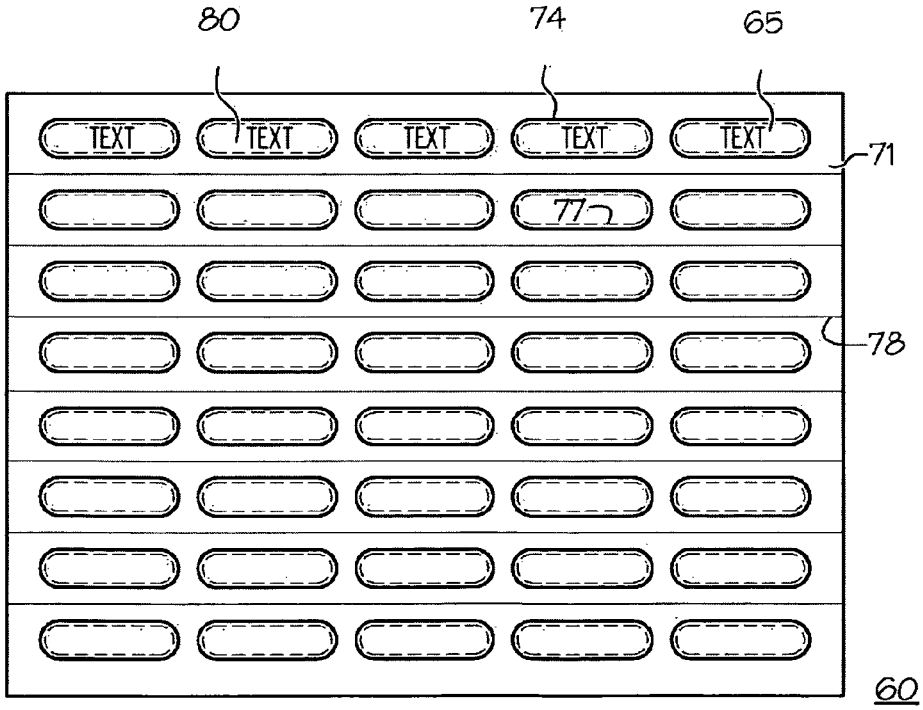
FIG. 12 is an enlarged front view of an alternate label sheet assembly according to another embodiment of the present invention.

Referring now to FIGS. 10-12, illustrated is another embodiment of a label sheet assembly 60 including a plurality of labels 65. FIG. 10 is a cross-section view taken through line 10-10 of FIG. 11. Similar to the embodiment illustrated in FIGS. 1-3, the label sheet assembly 60 is formed of multiple layers 62 that include a label facestock 64 adhered with an adhesive 67 to a carrier sheet 68. The carrier sheet may optionally include a silicone release layer (not shown), such as that described in FIG. 1 when adhesive 67 is not formed from an easily removable adhesive. The carrier sheet 68 is adhered with a heat activated coating 70 to a sheet 72, either a paper or a film. The heat activated coating 70 may be formed of a material such as polyolefin in a homogenous mixture or as a single component composition. In addition, heat activated coating 70 may be formed of a copolyester, ethylene vinyl acetate, ethylene vinyl alcohol, polyvinyl chloride, ionomer resins, ethylene methyl acrylate, ethylene ethyl acrylate, ethylene acrylic acid, or the like. Heat activated coating 70 and sheet 72 together form a liner sheet 73. Alternatively, the heat activated coating may be replaced with a removable adhesive, ultraremovable adhesive or pattern-coated adhesive, and thereby also not require a silicone release layer. Similar to the first embodiment, it should be understood that label facestock 64 includes a printable surface 76. The printable surface 76 may include surface treatments or coatings to enhance acceptance of indicia.

Referring more specifically to FIGS. 10 and 11, the label facestock 64 includes a plurality of cuts lines 74 that extend through the label facestock 64 and define the perimeter of one or more labels 65 or portions of labels. In this particular embodiment and similar to the first embodiment, different numbers of columns and rows or different patterns (non-matrix) of the labels or carrier strip may be formed as needed. In addition, the carrier sheet 68 includes a plurality of cuts lines 78 that extend through the carrier sheet 68 and define a plurality of cut edges 77 of at least one carrier strip 71 (FIG. 11). More specifically, as illustrated in FIG. 11, cut lines 74 that define the label 65 having an uppermost edge 66 that is straight across and inline with the cut lines 78 in the carrier sheet (FIG. 10), defining a top edge 75 of the carrier strip. The cuts lines 78 in the carrier sheet 68 (FIG. 10) further define a plurality of cut edges 77 in the carrier strip 71, wherein a small portion of the resulting carrier strip 71 covers a portion of each label 65 and a portion between the labels. This differential yields an overlap region that surrounds the perimeter of the label 65 and functions similar to the overlap region in the first embodiment, namely to lift up the array of labels 65 when the user separates the carrier strip 71 from the liner sheet 73.

Referring now to FIG. 12, illustrated is an alternate embodiment in which cut lines 74 define the label 65 in a central portion of the carrier strip. Similar to the embodiment illustrated in FIG. 11, the cuts lines 78 in the carrier sheet 68 further define a plurality of cut edges 77 in the carrier strip 71, wherein a small portion of the resulting carrier strip 71 covers a portion of each label 65 and a portion between the labels. This differential yields an overlap region that surrounds the perimeter of the label 65 and functions similar to the overlap region in the first embodiment, namely to lift up the array of labels 65 when the user separates the carrier strip 71 from the liner sheet 73. In the embodiments illustrated in FIGS. 11 and 12, sheet assembly 60 includes the liner sheet 73, including heat activated coating 70 and sheet 72, the carrier sheet 68, and the label facestock sheet 64 to form a laminate construction that is adapted to pass through a printer or copier multiple times in that the liner sheet is not cut and remains the same size. Desired indicia are printed on the labels 65 before the carrier strip 71 is removed to a separated position.

During application of the labels 65 illustrated in FIGS. 11 and 12 to a plurality of tabs on index dividers, folders, or the like, the carrier strip 71 is detached from the liner sheet 73 in a manner similar to that previously described with regard to the first embodiment. A portion 80 of the carrier strip 71 that covers the adhesive layer 67 where the plurality of labels 65 have been defined is left behind because it is attached to the heat activated coating 70. This defines a window area (not shown) in the carrier strip 71 and allows the adhesive on labels 65 to be exposed and, ready for application onto the aligned tabs. The user then proceeds like described with regard to FIGS. 6-8 to use the carrier strip 71 to align the array of labels 65 with the tabs of the dividers, file folders, or the like. After proper alignment, the user then applies the array of labels 65 and removes the carrier strip 71, leaving the labels 65 on the tabs. To prepare more labels 65 for new tabs, the user simply reruns the multipassable label sheet assembly 60 through the printer, printing on the subsequent array of labels to produce aligned, printed tab labels. It should be understood that the user can print as many labels as needed during a single printing process.

Figure 13:
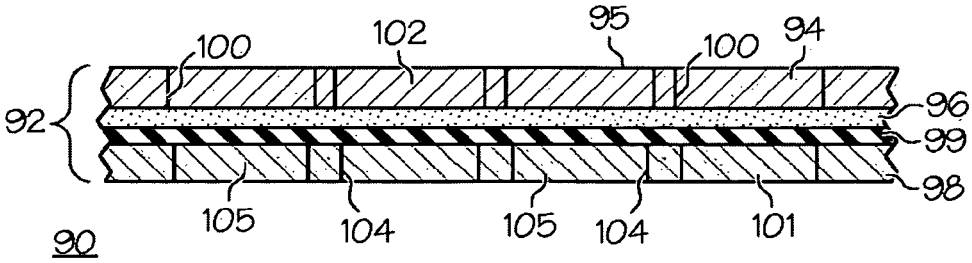
FIG. 13 is an enlarged cross-sectional view of a label sheet assembly taken along line 13-13 of FIG. 14 according to yet another embodiment of the present invention.
Figure 14:
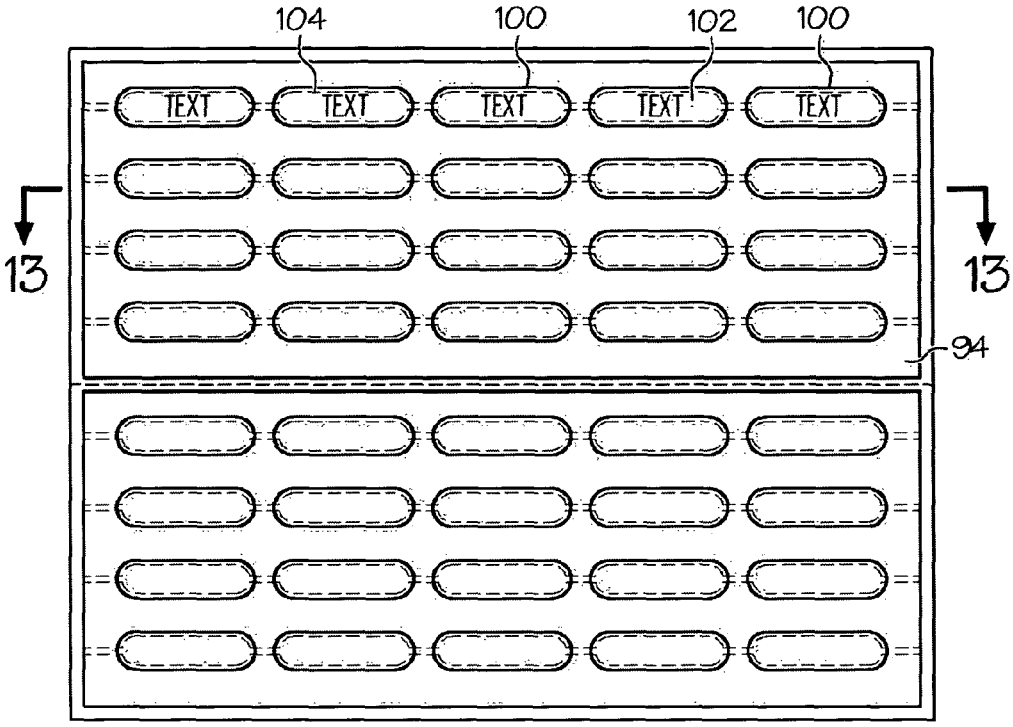
FIG. 14 is an enlarged front view of an alternate label sheet assembly according to another embodiment of the present invention.
Figure 15:
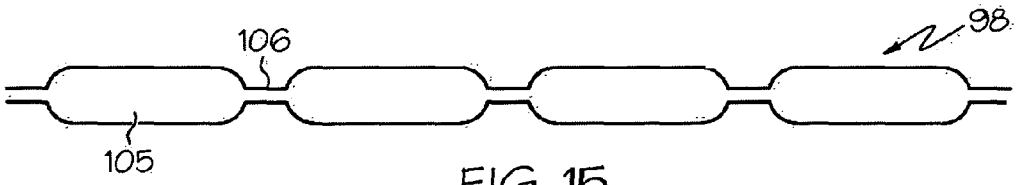
FIG. 15 is an enlarged top view of a portion of the carrier strip removed from the embodiment of FIGS. 13 and 14.

Referring now to FIGS. 13-15, illustrated are a cross-section view taken through line 13-13 of FIG. 14, a front view of the label sheet assembly, and a front view of a portion of the carrier sheet. The label sheet assembly 90 is formed of multiple layers 92 that include a label facestock 94 adhered with an adhesive 96 to a carrier sheet 98. It should be understood that carrier sheet 98 may optionally include a silicone release layer 99 as described in the previous embodiments. The carrier sheet 98 when cut serves a similar function as both the carrier strip and liner in the previous embodiments. Similar to the first and second embodiments, label facestock 94 includes a printable surface 95.

The label facestock 94 includes a plurality of cuts 100 that extend through the label facestock 94 and define a perimeter of one of more labels 102 or portions of labels. In this particular embodiment and similar to the first embodiment, different numbers of columns and rows or different patterns (non-matrix) of the labels can be formed as needed. The carrier sheet 98 includes a plurality of cuts 104 that extend through the carrier sheet 98. As in previous embodiments, cuts 104 are positioned slightly inward of cuts 100 about at least a portion of the label 102, so that the carrier sheet 98 overlaps the labels 102 about at least a portion of the perimeter, thereby defining an overlap.

During application of the labels 102 to a plurality of tabs on index dividers, folder, or the like, a plurality of portions 105 is removed from the sheet assembly 90, exposing the adhesive backing on labels 102. The portions of 105 may be removed individually, or may be removed in a strip, as best illustrated in FIG. 15. Portions of 105 have been cut to allow for a portion 106 of the carrier sheet 98 to remain and tie together the plurality of portions 105 upon removal to expose the adhesive backing on labels 102. The user then proceeds to maneuver the label sheet assembly 90 in order to align the array of labels 102 with a plurality of tabs of dividers, file folders, or the like. After proper alignment, the user applies pressure to the array of labels 102 and removes the label sheet assembly 90, leaving the labels 102 on the tabs. In this particular embodiment sheet assembly 90 includes the carrier sheet 98 and the label facestock sheet 94 to form a laminate construction that is adapted to pass through a printer or copier. In that the carrier sheet 98 is cut into portions 105 that are removed, the sheet assembly 90 is sufficiently structurally weakened with exposed adhesive and is only passable through a printer or copier a single time. An alternate embodiment may include a gutter, similar to a previous embodiment, in which each separate half of the sheet assembly may be passed through a printer of copier a single time. Desired indicia are printed on the labels 102 before the portions 105 are removed to a separated position.

Figure 16:
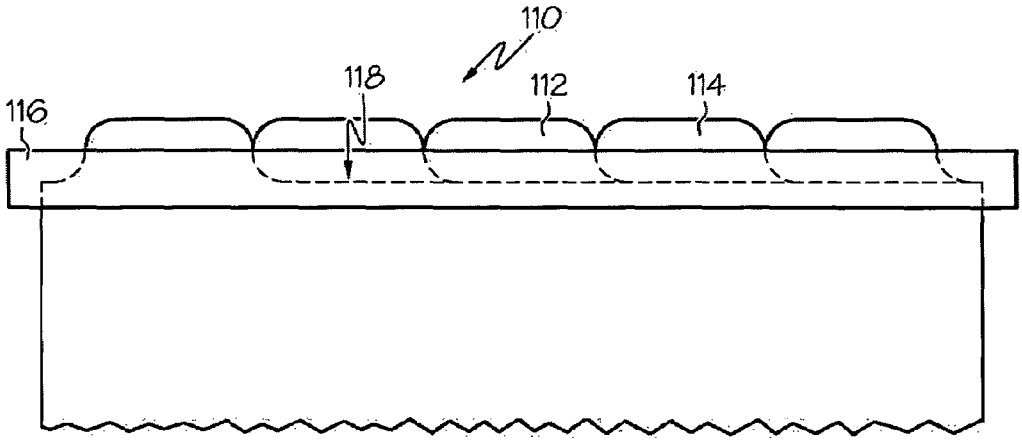
FIG. 16 is a simplified top view of an embodiment of an alignment guide for use with the label sheet assembly of the present invention.
Figure 17:
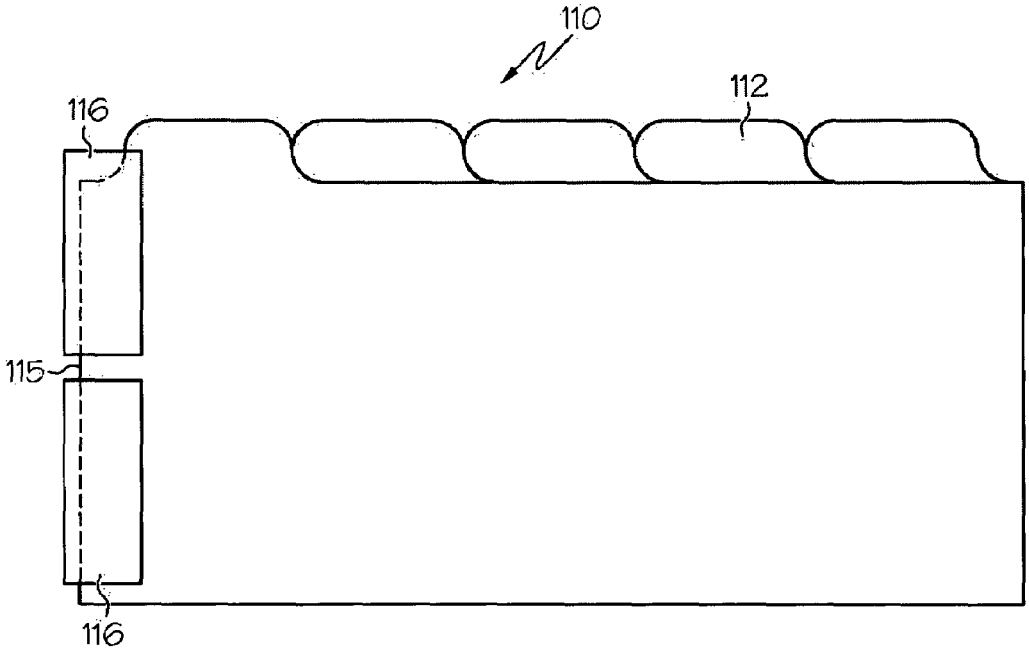
FIG. 17 is a simplified top view of another embodiment of an alignment guide for use with the label sheet assembly of the present invention.
Figure 18:
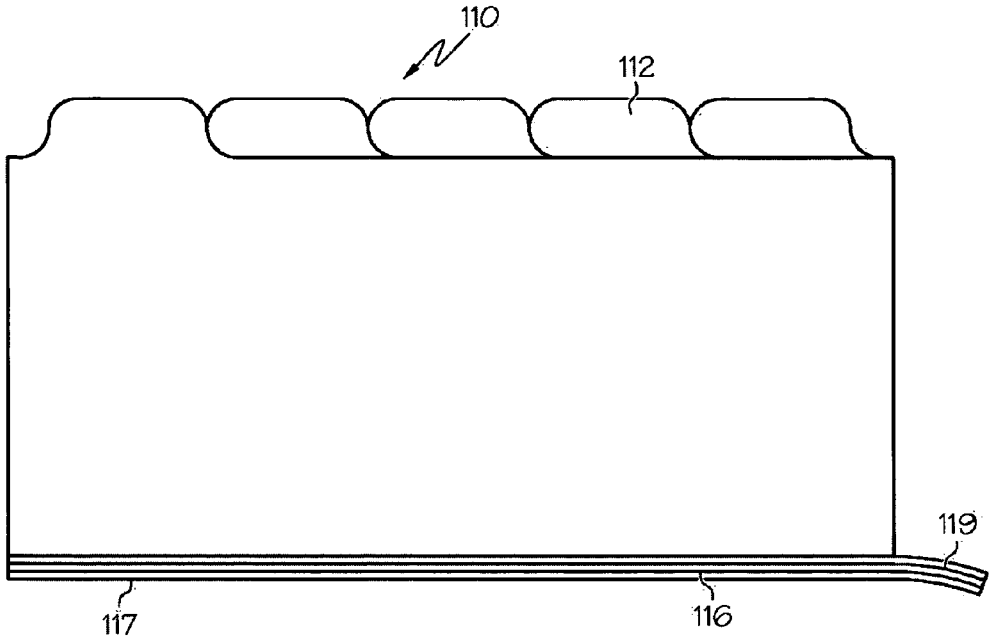
FIG. 18 is a simplified top view of another embodiment of an alignment guide for use with the label sheet assembly of the present invention.

Referring now to FIGS. 16-19, to minimize movement or shifting of a set of index dividers, file folders, or the like during the label application process, methods for temporarily aligning the set of index dividers are presented. As illustrated in FIGS. 16-18, provided is a set of index dividers 110, including a plurality of tabs 112 having a generally centralized portion 114 for placement of a label according to the present invention including identifying indicia. To provide proper alignment of the labels on tabs 112, the dividers 110 can be held in place by a single length or plurality of lengths, of removable tape 116 positioned across a lower portion 118 of the tabs 112 outside of the portion 114 where the labels will be adhered as illustrated in FIG. 16. In the alternative, a single length of a tape 116 or a plurality of lengths of tape 116 may be positioned across an edge 115, or multiple edges, of the set of index dividers 110 as best illustrated in FIG. 17 or across a binding edge 117 of the dividers 110 as best illustrated in FIG. 18. The tape 116 can be in the form of either a complete strip or a plurality of sections that are spaced apart, covering the entire length or width of the divider set 110 as illustrated. After the labels have been applied onto the tabs 112, the tape 116 is removed using an optional pull tab 119 as illustrated in FIG. 18 or by simply lifting and removing the tape 16 from the dividers 110. Alternatively, a glue or adhesive that does not leave undesired residue on the edges of the dividers 110 can be used in place of the tape 116.

Figure 19:
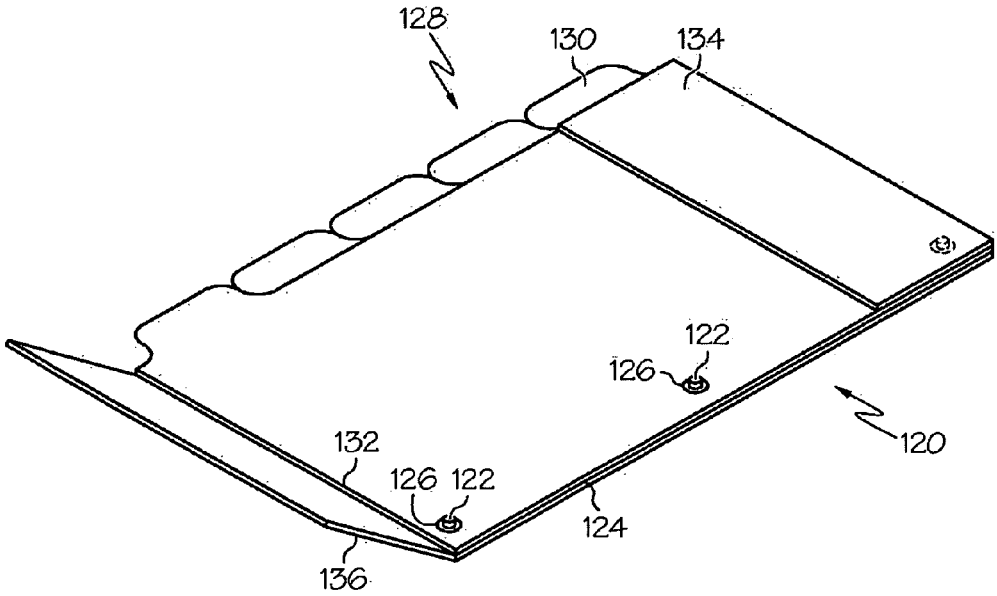
FIG. 19 is a simplified perspective view of yet another embodiment of an alignment guide for use with the label sheet assembly of the present invention.

Another method for aligning and securing sets of dividers during application of the labels according to the present invention uses an alignment guide as illustrated in FIG. 19. More specifically, provided is an alignment guide 120 comprising at least one post 122 positioned on an alignment strip 124 in a manner that would align with the rings in a typical binder in which a set of dividers 128 may be placed. In one embodiment, a series of at least two holes 126 are formed in the dividers 128 having a plurality of staggered tabs 130 to which a label is to be adhered. The at least one post 122 is smaller in dimensions than the holes 126 on the dividers 128, thereby allowing the at least one post 122 to fit through the holes 126. To position the dividers 128 for label application, a user places the dividers 128 onto the alignment guide 110, and more particularly places the at least one post 122 through the divider holes 126, making sure to align all the dividers holes 126 with at least one post 122. This ensures that the tabs 130 for each divider 128 will be aligned with the tab 130 on adjacent dividers 128 and that the set of dividers 128 will not shift during the label application process. The at least one post 122 can be manufactured using thermoforming, injection molding, profile extrusion, or other methods known to the industries. In addition, an optional flap 136 may be incorporated with the alignment strip 124 to allow for folding over, as illustrated at 134, at least one of the edges 132 of the set of dividers 128. It can be appreciated that posts, flaps or combinations of posts and flaps can be used as an alignment means. Alternative means for aligning the set of index dividers 128 of the present invention are also anticipated herein, for example, a pouch such as that taught in U.S. Pat. No. 6,803,084, assigned to the same assignee, and incorporated herein by this reference.

Utilizing the above methods of label sheet assembly, application and use of an alignment guide, it is possible to form any number of sheet configurations to include labels for staggered tabs on a set of index dividers, folders, or the like. In addition, this technology is not limited to desktop printable sheets or to sheets at all, as it could be utilized to produce fan folded or roll products with unique characteristics as well. Furthermore, the invention is not limited to index tab labels, but may include amongst other things address labels, or labels having a shape other than the illustrated rectangular shape. In addition, it should be appreciated that although all the cut lines in the various sheet assemblies are shown as being formed orthogonal to the edges of the sheet assembly, the cuts may be formed in a manner that is not orthogonal to the edges of the sheet assembly.

While at least one exemplary embodiment has been presented in the foregoing detailed description, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing the exemplary embodiment or exemplary embodiments. It should be understood that various changes can be made in the function and arrangement of elements without departing from the scope of the invention as set forth in the appended claims and the legal equivalents thereof.

What is claimed is:

1. A label sheet assembly, comprising:

a carrier strip having a front face and a back face opposite the front face;

a label facestock sheet, wherein said carrier strip is not formed from said label facestock sheet, and wherein said label facestock sheet is removably affixed with adhesive to the front face of the carrier strip in an overlying aligned manner, the label facestock sheet including a plurality of cut lines defining at least a perimeter of a plurality of labels spaced from one another in an offset manner that substantially corresponds to a set of staggered tabs extending outwardly from a stacked group of tabbed members having a predefined arrangement of tabs;

the carrier strip defined by a plurality of cut edges having substantially the same shape as a portion of the perimeters of the face stock labels, but with slightly smaller dimensions as its respective plurality of labels, wherein the carrier strip overlaps at least a portion of each of the plurality of labels defining an overlapping portion when the carrier strip is in a separated position away from the label sheet assembly, and the overlapping portion being adapted to expose a back adhesive surface of each of the labels in the plurality of labels when the carrier strip is in the separated position.

2. The assembly of claim 1, wherein the overlapping portion is further adapted to hold the plurality of labels during manipulation of the carrier strip to align the plurality of labels in desired positions relative to at least one surface and the labels applied to the at least one surface, wherein the at least one surface includes the staggered tabs of the stacked group of tabbed members.

3. The assembly of claim 1, wherein the carrier strip comprises a coating of a releasing agent disposed on the front face thereof.

4. The assembly of claim 1, further including a liner sheet having a front face and a back face opposite the front face, said carrier strip being distinct from and removably affixed to the liner sheet so as to overlay the front face of the liner sheet.

5. The assembly of claim 4, wherein the liner sheet is a heat sealable sheet.

6. The assembly of claim 4, wherein the liner sheet has a coating of a releasing agent disposed on the front face thereof.

7. The assembly of claim 1, wherein the label facestock sheet includes an ink and/or laser receptive label facestock sheet front face.

8. The assembly of claim 1, wherein the back adhesive surface comprises a removable or repositionable adhesive.

9. The assembly of claim 1, wherein the overlapping portion of the carrier strip present on a backside of each of the labels maintains alignment of the plurality of labels with respect to one another when in the removed position.

10. The assembly of claim 1, wherein the overlapping portion of the carrier strip present on a backside of each of the plurality of labels overlaps the perimeters of the plurality of labels.

11. The assembly of claim 1, wherein the overlapping portion of the carrier strip present on a backside of each of the plurality of labels has a wave shape.

12. The assembly of claim 1, wherein the overlapping portion of the carrier strip present on a backside of each of the plurality of labels has a shape that substantially divides the labels.

13. The assembly of claim 2, wherein the tabbed members are tabbed divider sheets.

14. The assembly of claim 2, wherein the tabbed members are tabbed folders.

15. The assembly of claim 1, wherein the carrier strip and the label face stock sheet form a laminate construction that is adapted to pass through a printer or copier and desired indicia printed on the labels before the carrier strip is removed to the separated position.

16. The assembly of claim 1, wherein a size of the label sheet assembly is unchanged after the carrier strip is removed from the assembly.

17. The assembly of claim 1, wherein a portion of the label face stock is removed to form a margin of the label sheet assembly.

18. A label sheet assembly, comprising:

a liner sheet;

a carrier sheet having a back face and a front face;

the carrier sheet back face removably affixed to the front face of the liner sheet in an overlying aligned manner;

a label facestock sheet removably affixed with adhesive to the front face of the carrier sheet in an overlying aligned manner, the label facestock sheet including a plurality of cut lines extending through the label facestock sheet but not through the carrier sheet, the plurality of cut lines defining at least a perimeter of a plurality of labels spaced from one another in an offset manner that substantially corresponds to a set of staggered tabs extending outwardly from a stacked group of tabbed members having a predefined arrangement of tabs, wherein the liner sheet, the carrier sheet and the label face stock sheet form a laminate construction sheet;

the carrier sheet including a plurality of cut lines extending through the carrier sheet but not through the label face stock sheet or the liner sheet and having substantially the same shape as a portion of the perimeters of the labels, but with slightly smaller dimensions as its respective label to define a plurality of carrier strips, wherein each of the carrier strips is capable of being removed from the liner sheet to expose an overlap of a portion of the label on the carrier strip and a back adhesive surface of each of the labels such that the carrier strip can assist the user in positioning the labels at desired locations on at least one surface and adhered thereto with the adhesive, wherein the at least one surface includes the staggered tabs of the stacked group of tabbed members.

19. The assembly of claim 18, wherein the liner sheets comprises a coating of a releasing agent disposed on a front face thereof.

20. The assembly of claim 18, wherein the carrier sheet comprises a coating of a releasing agent disposed on the carrier sheet front face.

21. The assembly of claim 18, wherein the labels are all the same size and shape.

22. The assembly of claim 18, wherein the label facestock sheet includes an ink and/or laser receptive facestock sheet, the carrier sheet is a paper, and the liner sheet is a release-coated paper liner sheet.

23. The assembly of claim 18, wherein the label facestock sheet includes an ink and/or laser receptive facestock sheet, the carrier sheet is a film, and the liner sheet is a heat sealable sheet.

24. The assembly of claim 18, wherein the back adhesive surface comprises a removable or repositionable adhesive.

25. The assembly of claim 18, wherein the overlap portion of the carrier strip present on a backside of the labels maintains alignment of the plurality of labels with respect to one another during alignment with the staggered tabs of the stacked group of tabbed members.

26. The assembly of claim 18, wherein the tabbed members are tabbed divider sheets.

27. The assembly of claim 18, wherein the tabbed members are tabbed folders.

28. The assembly of claim 18, wherein the liner sheet, the carrier sheet, and the label facestock sheet form a laminate construction that is adapted to pass through a printer or copier and desired indicia printed on the labels before the carrier strip is removed to a separated position.

29. The assembly of claim 18, wherein the overlapping portion of the carrier strip present on a backside of each of the plurality of labels overlaps a portion of the perimeters of the plurality of labels.

30. The assembly of claim 18, wherein a size of the label sheet assembly is unchanged after the carrier strip is removed from the assembly.

31. The assembly of claim 30, wherein the label sheet assembly is capable of passing through a printer or copier.

32. The assembly of claim 18, wherein a portion of the label face stock is removed to form a margin of the label sheet assembly.

33. A label sheet assembly, comprising:

a liner sheet;

a carrier sheet removably attached to the liner sheet, the carrier sheet including at least one weakened separation line defining at least in part a carrier strip;

a label facestock sheet removably attached to the carrier sheet, the label facestock sheet including at least one weakened separation line defining at least in part perimeters of a plurality of aligned labels;

the carrier strip being in an attached position on the liner sheet and being constructed so as to be positionable in an alternative removed position when removed from the liner sheet, portions of the bottom surfaces of the labels being exposed when the carrier strip is in the removed position, at least a portion of the perimeter of the labels overlapping the carrier strip to define a carrier strip overlap portion when the carrier strip is in the removed position away from the liner sheet and reversibly adhered thereto such that the labels are adapted to be applied in an aligned applied position to a plurality of staggered tabs; and an adhesive means for adhering the carrier sheet to the face stock sheet when in the attached position and for also adhering the labels to the staggered tabs when the labels are in the applied position.

34. The assembly of claim 33, wherein the labels are all the same size and shape.

35. The assembly of claim 33, wherein the label facestock sheet includes an ink and/or laser receptive facestock sheet, the carrier sheet is a paper, and the liner sheet is a release-coated paper liner sheet.

36. The assembly of claim 33, wherein the label facestock sheet includes an ink and/or laser receptive facestock sheet, the carrier sheet is a film, and the liner sheet is a heat sealable sheet.

37. The assembly of claim 33, wherein the adhesive means comprises an adhesive.

38. The assembly of claim 37, wherein the adhesive is a removable or repositionable adhesive.

39. The assembly of claim 37, wherein the adhesive is a pressure sensitive adhesive.

40. The assembly of claim 33, wherein a removable portion of the carrier sheet is removed to expose a backside of the labels from the sheet assembly.

41. The assembly of claim 33, wherein the liner sheet, the carrier sheet, and the label facestock sheet form a laminate construction that is adapted to pass through a printer or copier and desired indicia printed on the labels before the carrier strip is removed to the removed position.

42. An index divider label application kit comprising:

at least one set of divider sheets, each having outwardly extending divider tabs vertically offset from one another in a predetermined arrangement when the divider sheets overlay one another;

at least one pressure sensitive label sheet assembly including at least one carrier strip, a liner and a label face stock sheet, the at least one carrier strip and the label face stock sheet removably secured together by a layer of a pressure sensitive adhesive material and said carrier strip being sandwiched between the label face stock sheet and the liner and said carrier strip not being formed from the label face stock sheet;

the label face stock sheet including a plurality of cut lines defining a perimeter of a plurality of spaced apart precut labels aligned in an alignment configuration that corresponds substantially to the predetermined arrangement of the divider tabs extending outward from the divider sheets;

the at least one carrier strip including a plurality of cut edges having substantially the same shape as a portion of the perimeters of the facestock labels, but with slightly smaller dimensions as its respective label, such that when the at least one carrier strip overlies the divider tabs on the set of divider sheets, each of the precut labels is located on top of a respective divider tab; and the precut labels reversibly adhered to the at least one carrier strip about an edge that overlaps the at least one carrier strip;

an alignment guide for aligning the at least one carrier strip with the divider tabs on the set of divider sheets;

whereby a user is capable of (1) using the alignment guide to align the at least one carrier strip with the divider tabs on the set of divider sheets, (2) placing and aligning the at least one carrier strip across the divider sheets such that the precut labels affixed to the at least one carrier strip are placed on the divider tabs of the divider sheets, and (3) pulling the at least one carrier strip upwardly and away from the divider sheets such that the at least one edge of the label that overlaps the at least one carrier strip flexes about the at least one carrier strip when the at least one carrier strip is separated from the labels so that they remain on the divider tabs.

43. The application kit of claim 42, further including a liner sheet removably secured to the at least one carrier sheet.

44. The application kit of claim 42, wherein the alignment guide includes a plurality of alignment pins extending from a front face of an alignment strip and the divider sheets having a plurality of holes there through, in alignment with at least some of the plurality of alignment pins, the divider sheets being aligned when at least some of the plurality of pins are positioned within the holes formed in the divider sheets.

45. The application kit of claim 44, further including at least one flap capable of being folded over the dividers.

46. The application kit of claim 42, wherein the alignment guide includes a removable tape positioned on the divider sheets, thereby aligning the tabs of the divider sheets in proper alignment.

47. The application kit of claim 46, wherein the removable tape is positioned about at least one edge of the divider sheets.

48. The application kit of claim 46, wherein the removable tape has a pull tab.

49. The application kit of claim 42, wherein the label is constructed to return to a flat position after flexing.

* * * * *